US006116137A

United States Patent [19]

Strahan

[11] Patent Number: 6,116,137

[45] **Date of Patent: *Sep. 12, 2000**

[54] SLIDE AND BARREL COUPLER

[76] Inventor: Travis R. Strahan, 187 Townsend Cir., Ringold, Ga. 30736

[ * ] Notice: This patent issued on a continued prosecution application filed under 37 CFR 1.53(d), and is subject to the twenty year patent term provisions of 35 U.S.C. 154(a)(2).

[21] Appl. No.: 09/082,718

[22] Filed: May 21, 1998

[51] Int. Cl.[7] ..... F41A 21/32

[52] U.S. Cl. ..... 89/196; 89/14.05; 42/7

[58] Field of Search ..... 89/163, 14.3, 196, 89/199, 14.05; 42/7

[56] References Cited

U.S. PATENT DOCUMENTS

| | | | |
|---|---|---|---|
| 3,365,829 | 1/1968 | Shockey | 42/97 |
| 4,127,056 | 11/1978 | Kart | 89/128 |
| 4,338,740 | 7/1982 | Miller | 89/196 |
| 4,896,581 | 1/1990 | Cole | 89/163 |
| 5,549,030 | 8/1996 | Lespron | 89/14.3 |

*Primary Examiner*—Stephen M. Johnson

*Attorney, Agent, or Firm*—James B. Middleton; Walter A. Rodgers

[57] ABSTRACT

An automatic handgun has a support member fixed to the end of the barrel and engageable with the slide when the slide moves forward. The mating surfaces of the support member and the slide have clutch surfaces machined into them so the two surfaces lock together snugly, thereby holding the barrel and slide together accurately. A guide rod may also be fixed to the support member to assist in holding the proper relationship when the slide is moved rearwardly.

8 Claims, 1 Drawing Sheet

SLIDE AND BARREL COUPLER

BACKGROUND OF THE INVENTION

1. Field of the Invention

This invention relates generally to handguns and the like, and is more particularly concerned with means for improving the accuracy of the sights in an automatic by maintaining the alignment of the slide with the barrel.

2. Discussion of the Prior Art

Handguns such as the Springfield 1911-A1, .45 Caliber pistol are well known as reliable and well made pistols; however, the pistol is inherently not accurate at a great distance. Typically, the effective range is considered to be around 50 meters. Due to the overall quality of the pistol, it is a favorite for target shooters, but the accuracy is again a drawback. No matter how careful the shooter, a small grouping of shots cannot be maintained.

SUMMARY OF THE INVENTION

The present invention provides for improved accuracy of an automatic handgun by maintaining a substantially fixed relationship between the slide and the barrel of the pistol. A support member is mounted on the muzzle end of the barrel, and a guide rod extending between the slide and the support member assists in maintaining the desired relationship. When the slide is forward, the slide is firmly locked to the support member with an automatically aligning locking means. As a result, at the time of aiming the pistol the barrel and slide are definitely aligned. After firing, the guide rod assists in maintaining the alignment. Even after long use, the coupling means of the present invention maintains the desired relationship so the pistol retains its accuracy.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Referring now more particularly to the drawings, and to that embodiment of the invention here chosen by way of illustration, it should first be understood that the pistol illustrated is substantially the Springfield 1911-A1; however, this particular pistol is selected only by way of illustration and other makes of pistols could also be used. The invention will apply to any automatic pistol of the general type shown.

Figure 1:
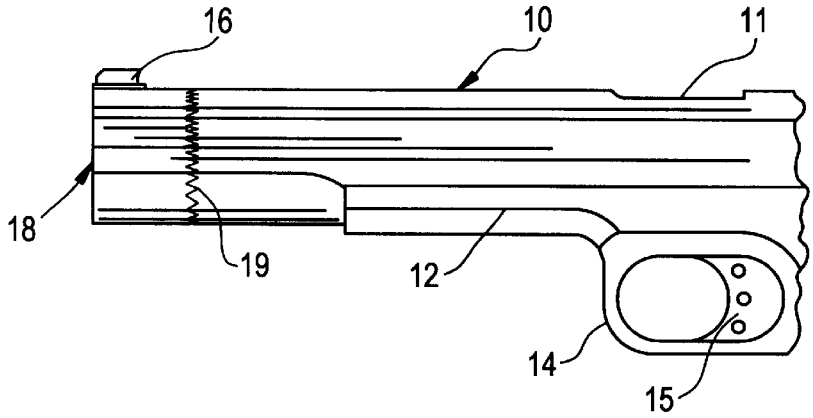
FIG. 1 is a partial side elevational view of a handgun embodying the coupler of the present invention, and showing the slide forward and locked to the support means.

FIG. 1 shows a portion of a pistol that is mostly conventional. There is a slide 10 having a shell ejection slot 11. A portion of the frame, or receiver, 12 is shown, which includes the trigger guard 14 and the trigger 15. In the conventional pistol of this type, the front sight 16 is mounted on the slide, but, in the device of the present invention, there is a support member 18 that is separated from the slide 10 along a zigzag line 19.

Figure 2:
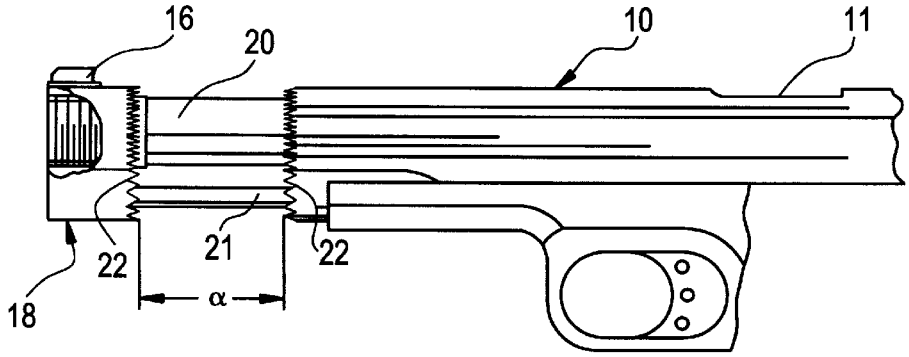
FIG. 2 is a view similar to FIG. 1 but showing the slide retracted; and, FIG. 3 is a face view of a piece of metal having the coupler surface thereon and showing the outline of the support means in phantom.

FIG. 2 of the drawings illustrates the device of the present invention with the slide retracted, so the barrel 20 and guide rod 21 are shown. Here it can be seen that the support means 18 is separate from the slide 10; and, at the broken out portion, it can be seen that the support means 18 is threadedly engaged with the muzzle end of the barrel 20. While other securing means may be selected, threads can be accurately cut and can provide an easy adjustment means. For example, one successful embodiment of the invention utilizes a thread that is 40 threads per inch. As a result, one rotation of the support means on the barrel 20 will move the support means 0.025 inch. This adjustment can be used to assure that the support member securely locks to the slide when the slide moves forward to the position shown in FIG. 1.

The specific locking means used in the arrangement of the present invention is shown as a clutch of a type that is well known in the art of machines and machining. The clutch is known as a positive clutch, as opposed to a friction clutch. That is to say, when the clutch is engaged, there is a mechanical connection between the two parts, rather than merely a frictional connection. The mechanical connection is provided by the interengagement of the teeth 22. Those skilled in the art will understand that many different shapes of clutch teeth 22 may be used, though the V-shaped teeth here shown are preferred for sure engagement without binding, or clashing before full engagement.

Figure 3:
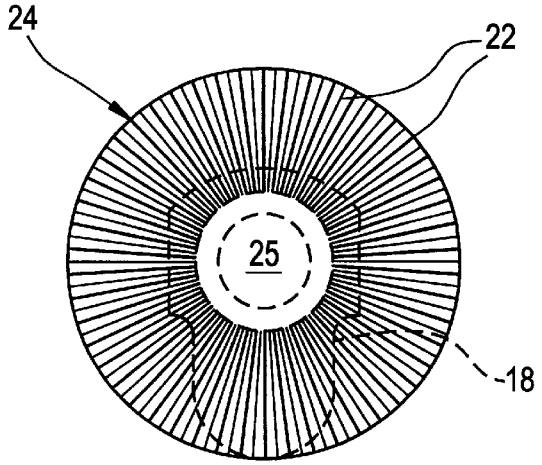

It must be understood that, since the object of the invention is to center the slide 10 with respect to the barrel 20, the center of the clutch teeth 22 must be at the center of the barrel 20. The layout for accomplishing this is shown in FIG. 3 of the drawings. A piece of round stock is shown at 24, with a hole 25 for receiving the barrel 20 in the center of the stock 24. The V-shaped teeth 22 are now cut into the stock 24 as shown in FIG. 3. After the teeth 22 are cut, the stock is milled down to the shape of the support means 18 as shown in phantom in FIG. 3. The end of the slide 10 will be similarly cut to provide the other member of the clutch.

Continuing to look at FIG. 3 of the drawings, it will be noticed that, since the barrel 20 is centered on the stock 24, the spacing of the V-shaped teeth 22 seems to vary when the support member 18 is viewed in side elevation. The lower portion of the support member is further from the center, so the radiating lines of the teeth 22 are farther apart.

Those skilled in the art will understand that, when the slide 10 of the pistol moves forward to the position shown in FIG. 1, the rear end of the barrel 20 moves up slightly. This upward motion is normally used to lock the parts in position to be ready for the next firing. The present invention utilizes this same motion to assure a tight lock between the parts of the clutch teeth 22. In FIG. 2, the angle between the two sets of clutch teeth is indicated at $\alpha$. The two sets of teeth will not be parallel when the slide is moved rearward. When the slide 10 moves forward, the upper portion of the clutch will engage, while the lower portion, in the area of the guide rod 21, will be slightly separated, then, when the rear end of the barrel 20 moves up, the lower portion of the clutch will be fully engaged. Thus, the angle $\alpha$ is equal to the angle the barrel 20 moves up to lock in place.

With the foregoing discussion in mind, it will be understood that the present invention provides means to lock the slide of an automatic pistol to the barrel, and to hold the alignment during firing of the pistol At the time of aiming, the slide is firmly locked to the barrel, so the sights are very accurate. Even after firing, when the slide moves rearwardly, the guide rod assists in holding the alignment so the pistol will maintain the proper alignment.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

What is claimed as invention is:

1. In a handgun comprising a frame, a barrel mounted on said frame and having a muzzle end and a rear end, a slide movable with respect to said barrel, a support member fixed to said muzzle end of said barrel in position to be engaged by said slide, said support member having a front face at said muzzle end of said barrel and a rear face, locking means defined on said rear face of said support member and complementary locking means defined on the forward end of said slide so that said locking means and said complementary locking means are mechanically interconnected when said slide moves forward to engage said support member, and said locking means and said complementary locking means comprising V-shaped teeth.

2. In a handgun as claimed in claim 1, a guide rod fixed to said support member for stabilizing said barrel while said slide is moved rearwardly.

3. In a handgun comprising a frame, a barrel mounted on said frame and having a muzzle end and a rear end, a slide movable with respect to said barrel, a support member fixed to said muzzle end of said barrel in position to be engaged by said slide, said support member having a front face at said muzzle end of said barrel and a rear face, a clutch defined on said rear face of said support member, a complementary clutch defined on the forward end of said slide, said clutch and said complementary clutch engageable when said slide moves forward to engage said support member, said handgun arranged such that the rear end of said barrel pivots up when said slide moves forward, and said clutch and said complementary clutch angularly related to each other, the angle being substantially equal to the angle said barrel pivots up.

4. In a handgun as claimed in claim 3, wherein said clutch is a positive clutch.

5. In a handgun as claimed in claim 4, wherein said clutch has V-shaped teeth.

6. In a handgun as claimed in claim 5, wherein said barrel is centered with respect to said clutch.

7. In a handgun comprising frame, a barrel mounted on said frame and having a muzzle end and a rear end, and a slide movable with respect to said barrel, the improvement comprising a support member fixed to said muzzle end of said barrel in position to be engaged by said slide, said support member having a front face at said muzzle end of said barrel and a rear face, a clutch defined on said rear face of said support member, a complementary clutch defined on the forward end of said slide so that said clutch and said complementary clutch are mechanically interconnected when said slide moves forward to engage said support member, said handgun arranged such that the rear end of said barrel pivots up when said slide moves forward, and said clutch and said complementary clutch are angularly related to each other, the angle being substantially equal to the angle said barrel pivots up.

8. In a handgun comprising a frame, a barrel mounted on said frame and having a muzzle end and a rear end, a slide movable with respect to said barrel, a support member fixed to said muzzle end of said barrel in position to be engaged by said slide, said support member having a front face at said muzzle end of said barrel and a rear face, locking means defined on said rear face of said support member and complementary locking means defined on the forward end of said slide so that said locking means and said complementary locking means are mechanically interconnected when said slide moves forward to engage said support member, said handgun being arranged such that the rear end of said barrel pivots up when said slide moves forward, said locking means and said complementary locking means being angularly related to each other, and the angle being substantially equal to the angle said barrel pivots up.

* * * * *

UNITED STATES PATENT AND TRADEMARK OFFICE

CERTIFICATE OF CORRECTION

PATENT NO. : 6,116,137
DATED : Sept. 12, 2000
INVENTOR(S) : Travis R. Strahan

It is certified that error appears in the above-identified patent and that said Letters Patent is hereby corrected as shown below:

On title page, item [76] add the following Inventor:
--Richard Vorwerk, 9226 Charbar Cir., Chattanooga, TN. 37421--

Signed and Sealed this

Tenth Day of April, 2001

*Attest:*

Nicholas P. Godici

NICHOLAS P. GODICI

*Attesting Officer*

*Acting Director of the United States Patent and Trademark Office*